United States Patent [19]

Kosakai

[11] 4,014,273

[45] Mar. 29, 1977

[54] MATTRESS COVERING SEWING MACHINE

[75] Inventor: Tamajiro Kosakai, Musashimurayama, Japan

[73] Assignee: France Bed Co., Ltd., Tokyo, Japan

[22] Filed: Dec. 23, 1975

[21] Appl. No.: 643,929

[30] Foreign Application Priority Data

Dec. 27, 1974 Japan ..... 50-522

[52] U.S. Cl. ..... 112/3 R

[51] Int. Cl.[2] ..... D05B 11/00

[58] Field of Search ..... 112/2, 3 R, 3 A, 117–119, 112/121.11, 121.12, 121.14, 121.15, 121.16, 121.23

[56] References Cited

UNITED STATES PATENTS

| | | | |
|---|---|---|---|
| 2,646,013 | 7/1953 | Haas | 112/3 R X |
| 3,641,954 | 2/1972 | Redman et al. | 112/3 R |
| 3,664,280 | 5/1972 | Redman et al. | 112/3 R |

*Primary Examiner*—G. V. Larkin

*Attorney, Agent, or Firm*—Flynn & Frishauf

[57] ABSTRACT

A mattress covering sewing machine has a pair of upper and lower support means on which a cushion is wrapped with a box-like outer cover and outer cover disposed under the open end of the box-like outer cover. The upper support means is adapted to be lowered so that the wrapped cushion is uniformly compressed in a direction of thickness of the wrapped cushion so as to permit the outer marginal edge portions of the adjacent outer covers to be sewn together. A sewing device is adapted to be moved around the entire outer marginal portions of the adjacent outer covers.

14 Claims, 12 Drawing Figures

MATTRESS COVERING SEWING MACHINE

CROSS-REFERENCE TO RELATED APPLICATION

U.S. Patent application Ser. No. 643,825, filed Dec. 23, 1975, and assigned to the same Assignee as the present application.

BACKGROUND OF THE INVENTION

This invention relates to a mattress covering sewing machine. A mattress consists basically of a cushion constituting an inner structure and an outer covering which three-dimensionally covers the cushion. The outer covering consists of a pair of upper and lower covers and a side cover i.e. a gusset which covers the side surface of the cushion. The upper cover and gusset are sewn together into a box-like configuration. The cushion is wrapped with the box-like configuration. The cushion is wrapped with the box-like cover and the lower cover is placed under the open end of the box-like cover and the corresponding outer marginal edge portions of the adjacent covers are sewn together to form a mattress. In this case, it is required that the outer covering be tightly wrapped around the entire periphery of the cushion without leaving any sagging. For this reason, the outer cover is made somewhat smaller in size than the outer shape of the cushion. When the outer marginal edge portions of the adjacent outer covers are finally sewn together, it is necessary that the cushion be storongly compressed with the elbow of the sewer so that the outer marginal edge portions of the adjacent outer covers are sewn together to form a mattress. For this reason, a high skill is required on the side of the sewer and it is impossible to uniformly compress the cushion with the elbow of the sewer and, in consequence, mass produce uniform mattresses.

SUMMARY OF THE INVENTION

It is accordingly the object of this invention to provide a mattress covering sewing machine capable of automatically mass producing uniform mattresses for a short time period without requiring any skill by automatically sewing together the outer marginal edge portions of the outer covers.

According to this invention a box-like outer cover is wrapped over the cushion and after disposing another cover under the open end of the box-like outer cover the wrapped cushion is automatically and uniformly compressed, in the direction of the thickness of the wrapped cushion, by the support plate to permit the outer marginal edge portion of the adjacent outer covers to be projected outward. The outer marginal edge portions of the adjacent outer covers are automatically sewn together around the entire periphery of the wrapped cover to form a mattress.

Even when the width of the mattress differes i.e. the mattress is of a double-, semi-double- or single-size, the wrapped cushion is located in a position to sufficiently compress the wrapped cushion for sewing and, in addition, the upper and lower support plates can be preferably adjusted so as to correspond to the width of the mattress. When the mattress differs in its thickness, the lower support plate can be preferably raised or lowered so that a sewing level can be maintained constant.

DETAILED DESCRIPTION OF THE PREFERRED EMBODIMENT

Figure 1:
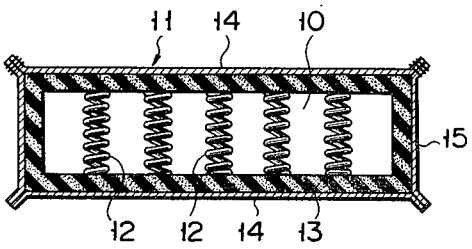
FIG. 1 is a transverse cross-sectional view schematically showing a mattress as formed by a sewing machine according to this invention.

A mattress made by a mattress covering sewing machine according to this invention consists basically of a cushion 10 and an outer covering 11 for wraping the cushion 10. The cushion 10 constitutes a flattened box-like layer 13 within which a plurality of compression springs 12 are disposed. The outer covering 11 consists of three covers i.e. upper and lower covers 14 and a side cover (i.e. gusset). One cover 14 and gusset 15 are sewn at their adjacent marginal edge portions to form an open box-like cover. The open box-like cover is wrapped over the cushion 10 and the other cover 14 is placed under the open end of the box-like cover and then the cover 14 and the adjacent gusset are sewn at their adjacent marginal edge portions to provide a mattress.

Figure 2:
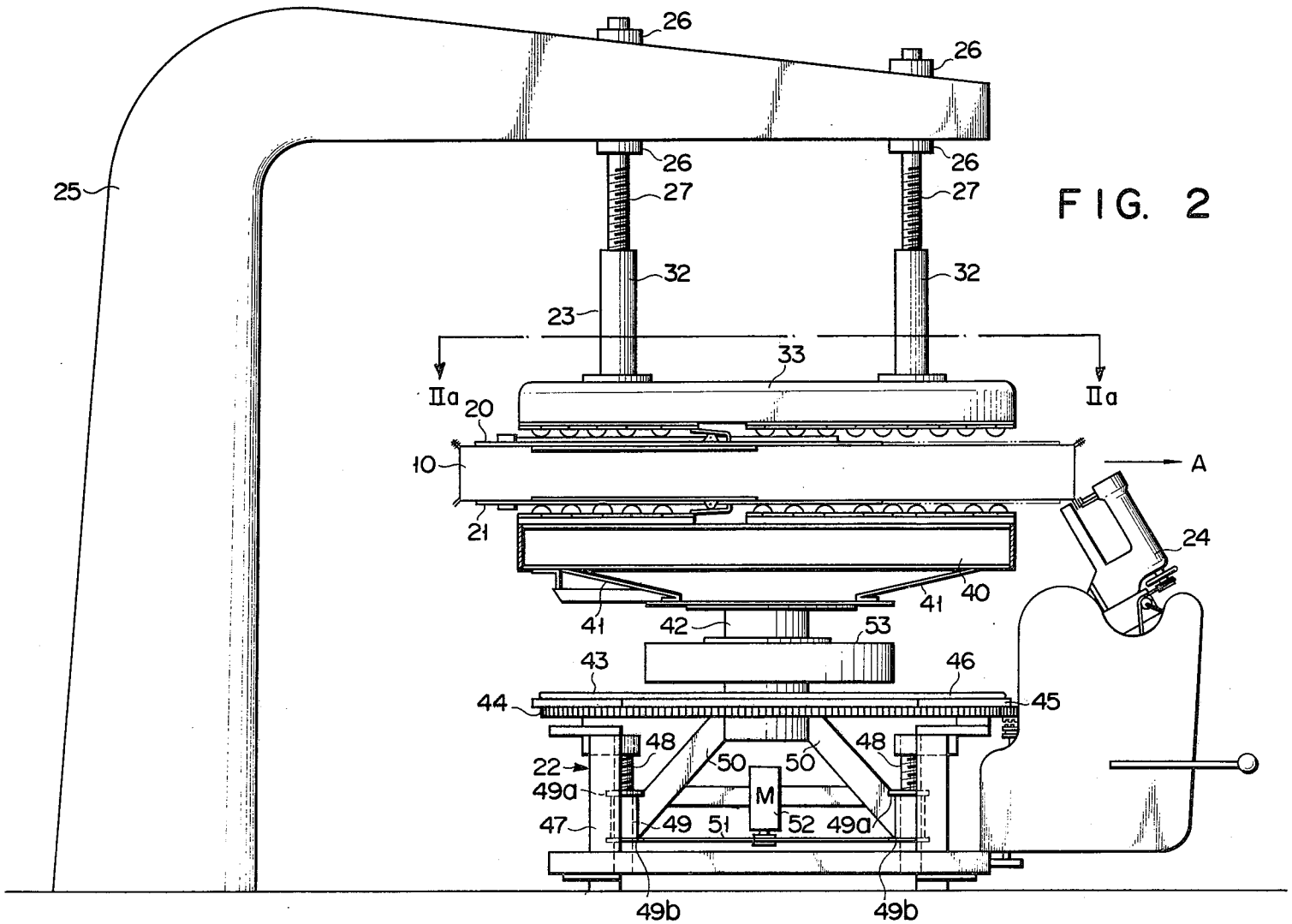
FIG. 2 is a side elevational view showing a sewing machine according to one embodiment of this invention.
Figure 2A:
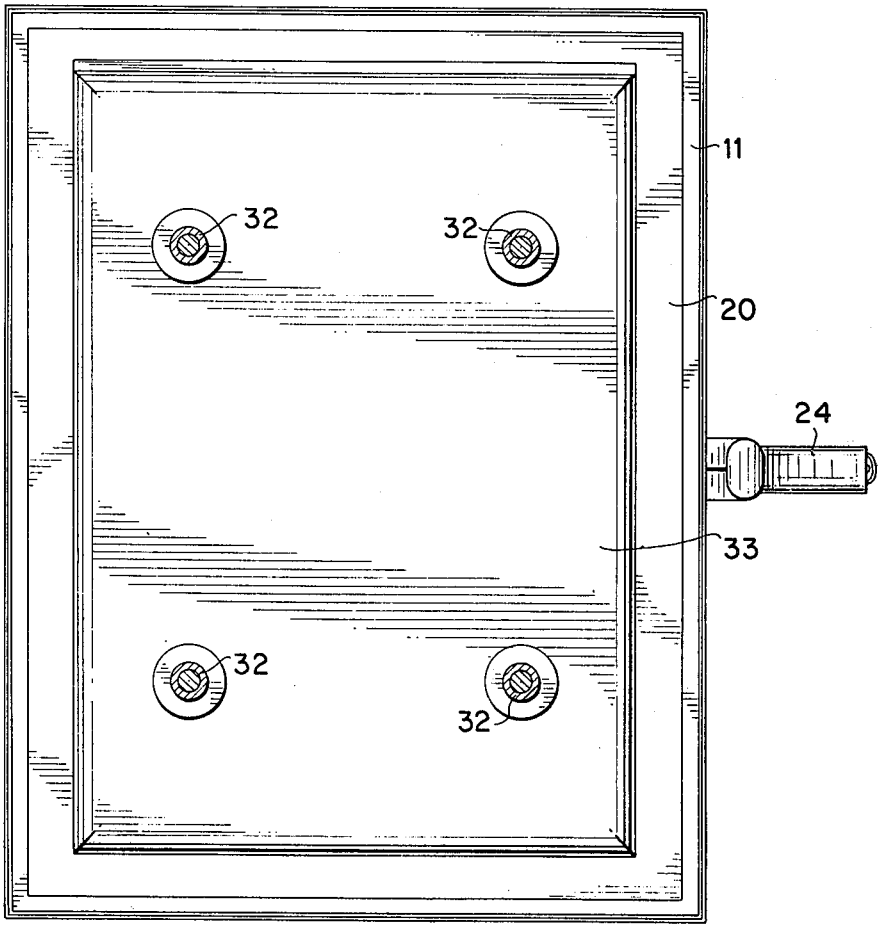
FIG. 2*a* is a partial sectional view along the line II*a*—II*a*in FIG. 2.

FIGS. 2 and 2*a* show a mattress covering sewing machine according to a preferred embodiment of this invention. In FIG. 2 the sewing machine includes a pair of upper and lower flat support plates 20, 21 adapted to supportingly sandwich therebetween a cushion covered with upper and lower covers; means 22 for supporting the lower support plate 21 so as to be vertically moved, compression means 23 for uniformly compressing the cushion, in a diretion of thickness of the covered cushion, between the support plates 20 and 21 by lowering the upper support plate 20 and a sewing device 24 for sewing together the marginal edge portions of the adjacent covers.

An inverted L-shaped stand 25 projects over the support plates 20 and 21 and has the compression means 23 on the overhanging forward end portion. Four drive shafts 27 are vertically disposed from the overhanging forward end portion of the inverted L-shaped stand 25 and rotatably journaled within radial bearings 26. Each bearing 26 restricts the axial movement of a rotatable shaft 27.

Figure 3:
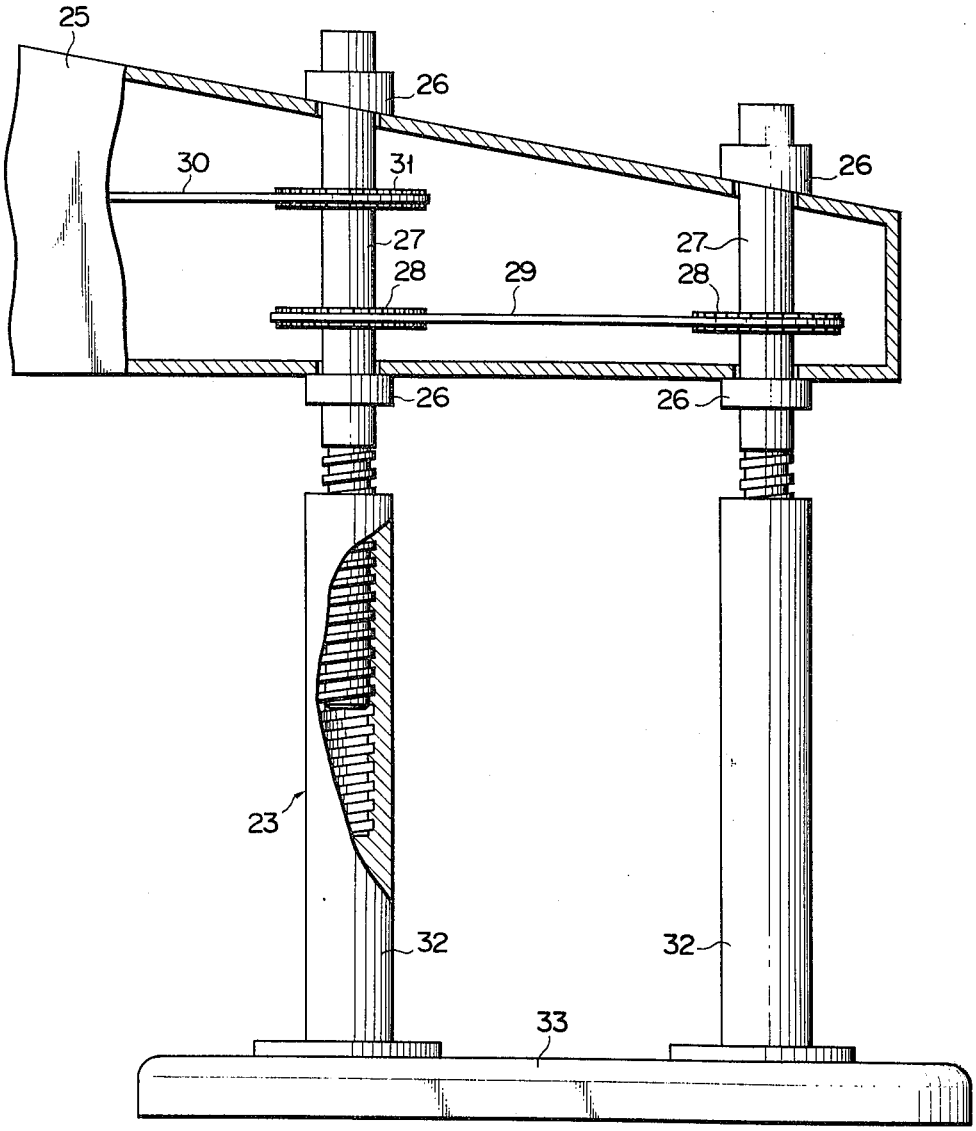
FIG. 3 is an enlarged, side elevational view, as partly broken away, showing a compressing means in the sewing machine of FIG. 2.

As shown in FIG. 3, the inverted L-shaped stand 25 is of a hollow type within which toothed pulleys 28 are mounted on the respective shafts 27. A common toothed belt 29 is trained around the pulleys 28. On one of the shafts 27 is mounted another pulley 31 connected by a toothed belt 30 to a motor (not shown). The four drive shafts 27 can be simultaneously rotated by driving the motor. The extending end portion of the drive shaft has an external thread in mesh with an internal thread formed in a connector 32. See also FIG. 2*a*. The connector 32 is secured at its lower end to the top surface of an upper base 33. The upper support plate 20 is mounted below the upper base 33 so as to permit the former to be vertically moved as a unit. When the motor is driven to cause the drive shaft 27 to be rotated, the upper support plate 20 is vertically moved through the connector 32 and upper base 33. As will be easily understood, if an external thread is provided on the connector and an internal thread in the extending end portion of the drive shaft, the same result will be obtained. The upper support plate 20 is supported relative to the upper base 33 so as to be movable, by a mechanism as will later be described, in the direction of the width of the mattress. The lower support plate 21 is adapted to be vertically moved by support means 22. As shown in FIG. 2, the support means 22 has a lower base 40 disposed below the lower support plate 21 and is adapted to be supportingly movable in a direction indicated by an arrow A. Reinforcing plates 41 are mounted diagonally on the lower base 40 so as to reinforce the lower base 40. The top surface of a movable column 42 is secured to the central portion of an assembly of the reinforcing plates. The lower end of a movable column 42 extends downward from the central portion of a table 43. The table 43 is formed to have a size substantially the same as those of the upper and lower bases 33 and 40, and a rack 44 is formed around the outer periphery of the table 43. First and second rails 45 and 46 are formed on the outer periphery of the table 43. The table 43 is supported by four legs 47 and threaded guide bars 48 extend in a vertical direction and are secured in the neighborhood of each leg 47. A nut member 49 is screw threaded with respect to the guide bar 48 and a connecting rod 50 is connected between the nut member 49 and the end portion of the movable column 42. While one end of the connecting rod 50 is secured to the end portion of the movable column 42, the other end portion of the connecting rod 50 constitutes a sleeve portion in which the nut member is loosely fitted. A pair of flanges 49*a* and 49*b* is formed one at the upper end and one at the lower end of the nut 49. The lower flange 49*b* of the nut 49 is used as a pulley, around which a drive belt 51 is entrained. The belt is also entrained on a belt wheel mounted on a drive shaft of a motor 52 which is mounted on the connecting rod 50. When the motor 52 is rotated, the four nut members 49 are rotated through the belt 51 to be moved up and down along the guide bar 48. The up and down movement of the nut 49 causes the sleeve portion of the connecting rod 50 to be moved up and down, permitting the up and down movement of the movable column 42 supported by the connecting rods. The up and down movement of the lower support plate 21 is effected through the reinforcing member 41 and lower base 40. Even when a cushion having different thickness is used, a sewing operation can be effected always at a constant level by vertically moving the lower support plate 21. Reference numeral 53 shows a collecting mechanism having a rotation electrode connected to a drive motor for sewing and a fixed electrode electrically connected to both a rotation electrode and a power source (not shown).

Figure 4:
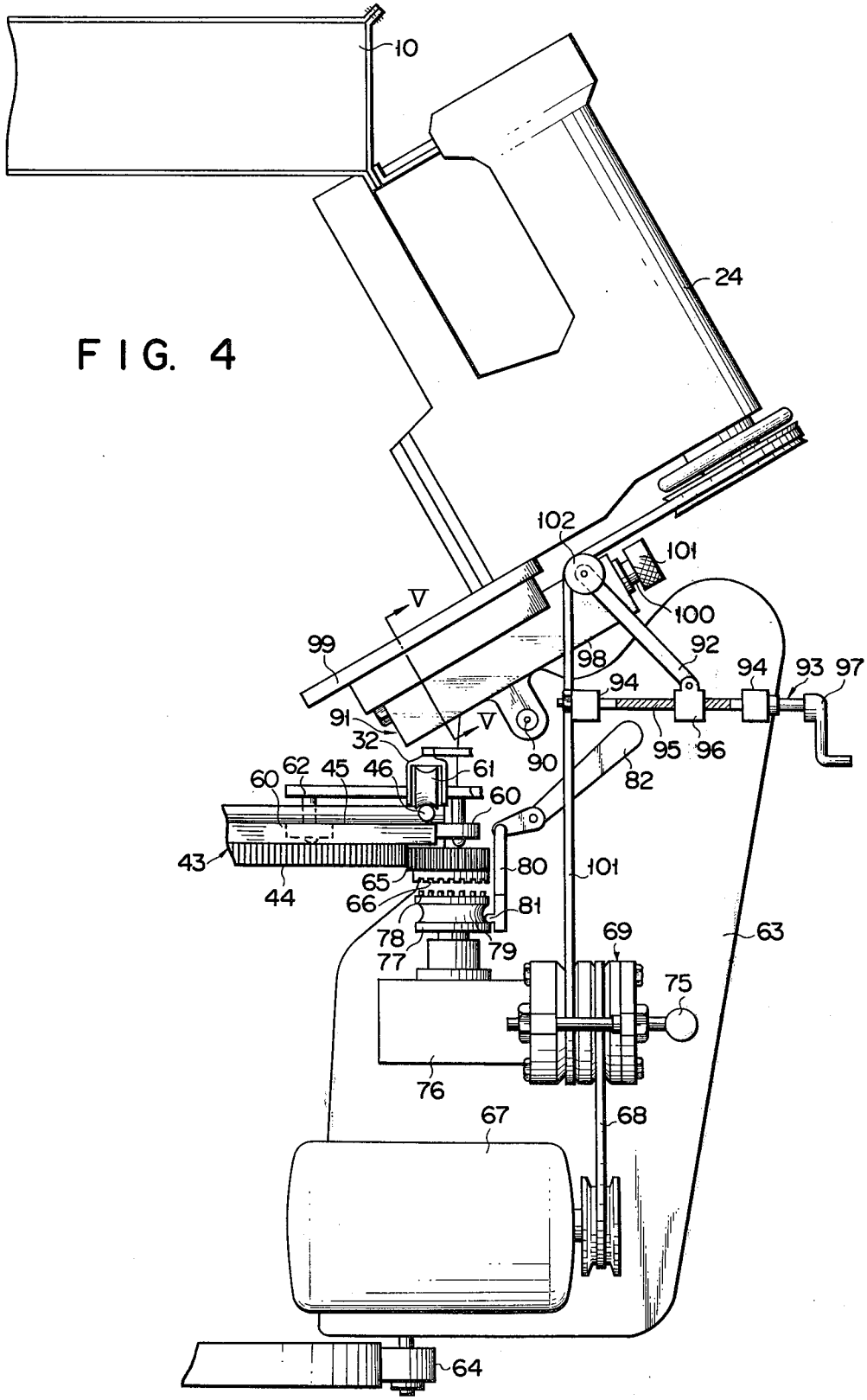
FIG. 4 is a detailed front view showing a carrier means in the sewing machine of FIG. 2.

As shown in FIG. 4 a sewing device 24 for sewing together the outer marginal edge portions of the mattress covers sandwiched between the support plates 20 amd 21 is provided in the neighborhood of the table 43 so as to be moved around the table 43. The first rail 45 of the table is formed in the form of a flat plate and the second rail 46 is formed in the form of a shaft and secured to the first rail 45. The first rail 45 is sandwiched between a pair of rollers 60 and a roller 61 rides on the second rail 46. The rollers 60, 61 are held on a retainer assembly 62 which is mounted on a carrier member 63 for supportingly feeding the sewing device 24. A roller 64 for holding the carrier member 63 in a predetermined position is mounted at the lower end of the carrier member 63 and abutted against the lower marginal edge portion of the table. On the carrier member 63 is mounted a pinion gear 65 adapted to hold the retainer 62 and be engaged with the rack 44 of the table 43. Engaging grooves 66 are provided in the undersurface of the pinion gear 65. A motor 67 is mounted at the lower portion of the carrier member 63 and it is connected through a drive belt 68 to a clutch mechanism 69.

The clutch mechanism 69 is connected through a drive gearing 76 to an engaging member 77. The engaging member 77 is vertically movable toward and away from the pinion gear 65. On the top surface of the engaging member 77 are provided a plurality of engaging projections 78 engageable with the grooves 66 of the pinion gear 65. At the outer periphery of the engaging member 77 is formed an annular groove 79, semicircular in cross section, with which a projection 81 of a lever 80 for raising and lowering the engaging member 77 is engaged. The lever 80 is operated by the operating lever 82. The engaging member 77 can be engaged with the groove 66 by swinging the operating lever 82 and raising the lever 80. The driving force of the motor 67 is transmitted to the pinion 65 through the clutch mechanism 69, drive gearing 76 and engaging member 77. As a result, the carrier member 63 on the pinion 65, together with the sewing device, can be moved around the outer periphery of the table 43 and the outer marginal edge portions of the mattress covers 14 and 15 can be sewn by the sewing device.

Figure 5:
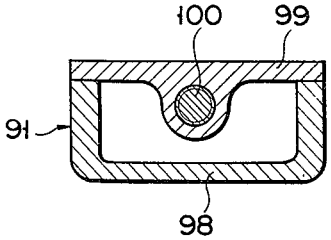
FIG. 5 is a cross-sectional view as taken along line V—V in FIG. 4.

At the upper portion of the carrier member 63 a rotating body 91 is rotatably mounted by a shaft 90. The rotating body 91 is connected through a connecting lever 92 to an adjustment mechanism 93. The adjustment mechanism 93 has two ball bearings 94 mounted on the carrier member 63, a drive shaft 95 rotatably supported at each end portion by the bearing 94 and having an external thread at its middle section so as to restrict the axis movement of the drive shaft 95, and an internally threaded nut member 96 engaged with the external thread of the drive shaft 95 so as to be movable along the axis of the drive shaft. A crank handle 97 is mounted on the end of the drive shaft 95. The rotating body 91 has a guide member 98 mounted on the carrier member 63 and a slide plate 99 adapted to hold the sewing device 24 and be slidably movable along the guide member 98. Between the front and rear sides of the guide member 98 an externally threaded drive shaft 100 is rotatably mounted, while being restricted in its axial movement. A cylindrical knob 101 is mounted on one end of the drive shaft 100 which is projected from the front side of the guide member 98. The slide plate 99 is threadably connected to the drive shaft 100 as shown in FIG. 5. On the guide member 98 is mounted an idler pulley 102 for a drive belt 101 adapted to transmit driving power from the clutch mechanism 69 to the sewing device 24. The connecting lever 92 is pivotally connected to the idler 102. By rotating the crank handle 97 of the rotating body adjusting mechanism 93 the rotating body 91 is rotated about the shaft 90. The slide plate 99 can be reciprocably moved by rotating the knob 101.

As a result, the sewing device on the slide plate 99 can be moved to a position suitable for a sewing operation.

Figure 6:
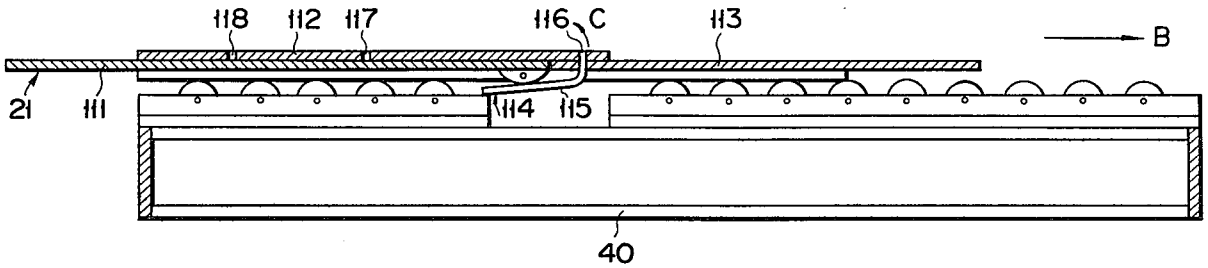
FIG. 6 shows one position taken by a lower support plate in the sewing machine in FIG. 2.
Figure 7:
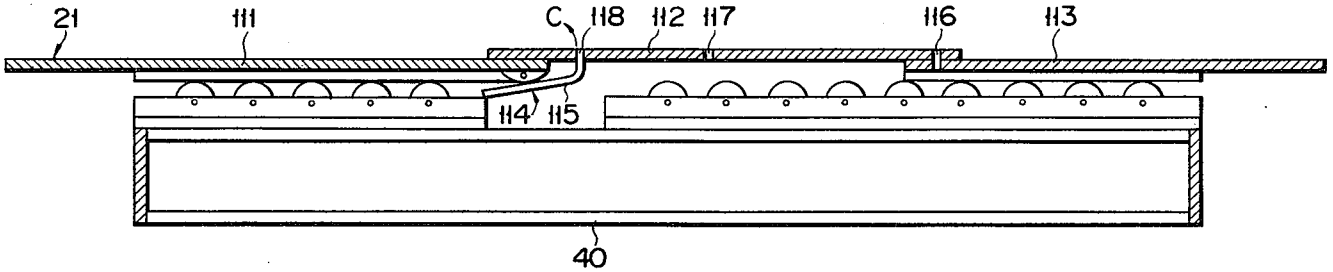
FIG. 7 shows another position taken by the lower support plate in FIG. 6.

The structure of the paired support plates 20 and 21, as well as the moving mechanism, will be explained by referring particularly to FIGS. 6 to 8. Since the upper support plate 20 is similar in structure to the lower support plate 21, only the lower support plate 21 will be described below. The lower support plate, though formed in a rectangular configuration, comprises three plates 111, 112 and 113 as will be understood from FIG. 6 or 7. The first plate 111 extends in the same plane as the third plate 113 and the second plate 112 is connected at its one end portion to the end portion of the third plate and is disposed on the third plate. When the lower support plate 21 is in a first position (a "single width" position) as shown in FIG. 6, the first plate 111 abuts against the third plate 113 and the second plate 112 is positioned on the first member side. When, on the other hand, the third plate 113 is moved in a direction indicated by an arrow B so as to be brought up to a second position (a "double width" position) as shown in FIG. 7, the second plate 112 slides on the first plate 111 and only the end portion of the second plate 112 is disposed on the first plate 111. The support plate 21 can be so positioned as to be brought to an intermediate position ("semi-double" or third position) between the first and second positions. On the lower surface of the first plate 111 is mounted a latch mechanism 114 for restricting the movement of the first, second and third members 111, 112 and 113. The latch mechanism 114 has an engaging lever 115 spring-urged in a direction indicated by an arrow C. The forward end of the lever 115 is fitted into engaging holes 116, 117 and 118 in the lower support plate 21 so as to hold the lower support plate 21 in position. The first and second positions of the lower support plate 21 correspond to the engaging holes 116 and 118 in the lower support plate and the third position of the lower support plate corresponds to the engaging hole 117 in the lower support plate 21.

Figure 8:
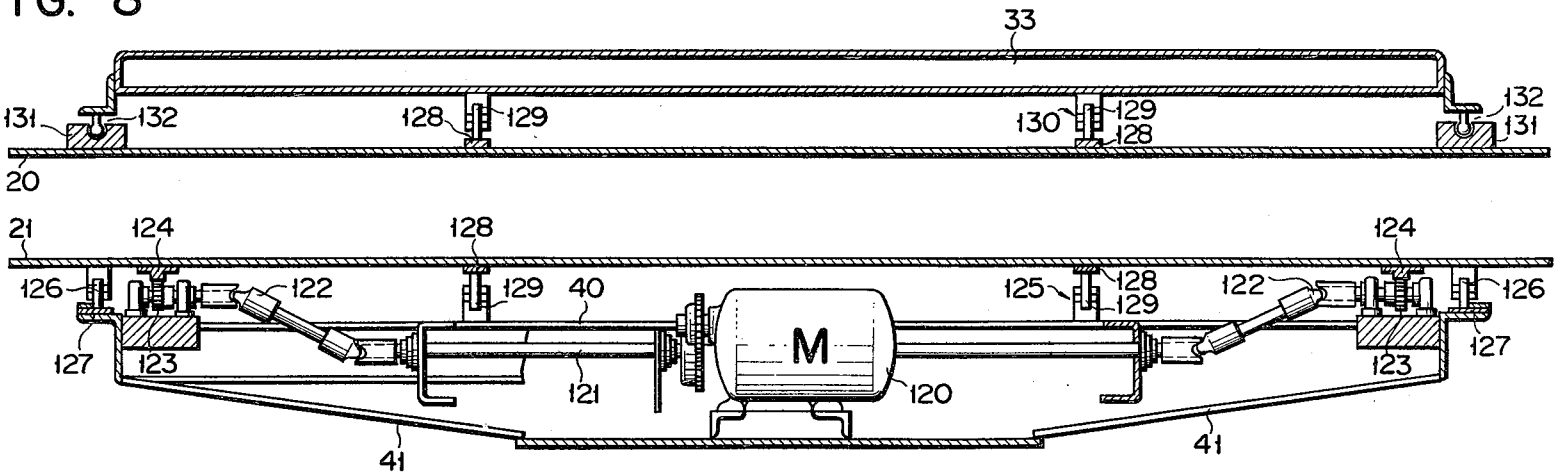
FIG. 8 is an enlarged view showing a mechanism for moving the support plate in a direction of width of a mattress.

In order to move the support plate 21, a motor 120 and a rotatable shaft 121 extending in a lengthwise direction of the lower support plate 21 are provided on the base 40 as shown in FIG. 8. The rotatable shaft 121 is operatively coupled to the drive shaft of the motor 120 through a pair of gears. A pinion 123 is coupled through a universal joint 122 to each end of the shaft 121. The pinion 123 is rotatably supported in a bearing provided on the base 40. On the undersurface of the support plate 21 is provided a rack 124 extending in a width direction of the mattress. When the shaft 121 is rotated by the motor through the paired gears, the pinion 123 is rotated through the universal joint 122. The support plate 21 can be moved in the direction of the width of the support plate 21 (i.e. the mattress) by the engagement of the pinion 123 with the rack 124.

Between the support plate 21 and the base 40 is provided a guide mechanism 125 for smoothly moving the support plate 21. The guide mechanism 125 has a combination of guide rolls 126 and guide rail 127 and a combination of a pair of guide rails 128 and a corresponding pair of guide rolls 129 on the support plate. The guide rolls 126 are provided in a line along the opposite outer end portions of the support plate 21 and the guide rail 127 is mounted immediately below the roll 126 and having a somewhat raised outer end. The guide rail 128 is provided on the undersurface of the support plate 21 and in a position relatively remote from the side of the support plate 21 so that it faces the guide roll 129.

The same mechanism 130 is also provided between the upper support plate 20 and the base 33 so as to guide the upper support plate. That is, guide rolls 129 are provided in a line along the opposite outer end portions of the upper base 33 and a pair of rails 128 are provided so as to guide the roll 129. A combination of outer and inner rails 131 and 132 can be provided on the opposite end portions of the upper plates 20. The outer rail 131 extends across the width of the upper support plate and the inner rail 132 is mounted on each side of the upper base 33, the large diameter lower end portion of the inner rail 132 being guided in the outer rail 131. The inner rail 132 is guided, in a horizontal direction (i.e. in a direction of width of the mattress), along the outer rail, but the inner rail 132 together with the outer rail 131 can be moved, as a unit, through a large diameter lower end portion of the inner rail 132.

Figure 9:
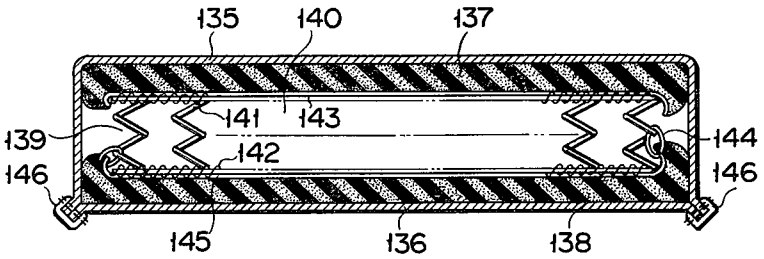
FIG. 9 is a transverse cross-sectional view schematically showing another mattress as formed by the sewing machine in FIG. 2.

FIG. 9 shows another mattress sewn together by the sewing machine.

In FIG. 1 the mattress is formed by sewing together the marginal edge portions of the outer covers including the gusset. In the mattress shown in FIG. 9, however, a sheet of covering is cut into a rectangular shape with a rectangular cutout 135*a* at each corner. To explain more in detail, the mattress comprises a box-like outer cover 135, a flat cover 136 and a cushion 140 having a spring unit 139 covered, at the upper and lower surfaces, with pads 137 and 138. The spring unit 139 has an array of spring coils 141 connected by wires 142 to a mounting member 143. The pads 137 and 138 extend inward at their ends. Hook rings 144 are connected to the outermost coil springs around the entire outer periphery of the pad. Reference numeral 145 is an absorbing member for separating the pad from the mounting member and reference numeral 146 is a tape edge covered on the outer marginal edge portion of the outer covers 135 and 136. When the mattress is formed using three flat outer covers, it is necessary to attach hook rings around the entire periphery of the pad so as to prevent a collapse.

Figure 10:
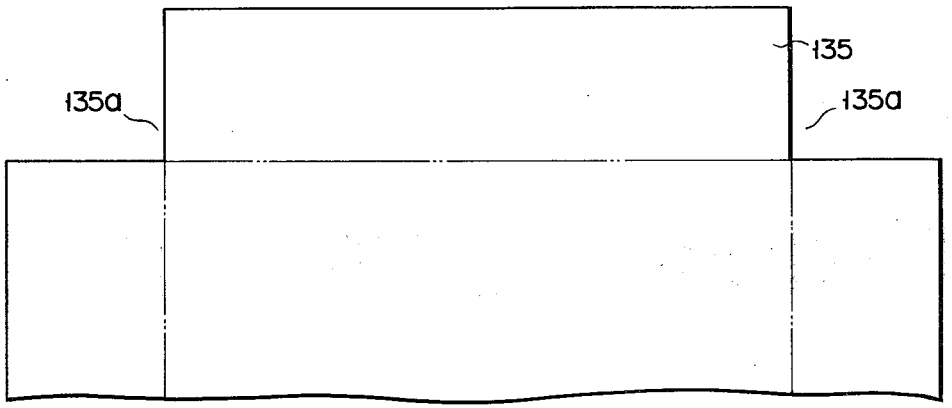
FIG. 10 is a development view showing an outer cover of a mattress in FIG. 9.

In the mattress using the outer cover as shown in FIG. 10, the shape of the mattress is deformed at the side of the outer cover and hook rings are required only for the outermost coil springs around the entire outer periphery of the pad. In consequence, the manufacturing step is a partially saved and collapse-free mattresses are mass produced at low cost.

The operation of the mattress outer cover sewing machine will now be described below.

The upper and lower support plates 20 and 21 are positioned so as to correspond to the size of the mattress. That is, the upper and lower support plates 20 and 21 are located through a suitable operation of the motor 120 into the single width position as shown in FIG. 6, into the double width position as shown in FIG. 7 and into the semi-double width portion. A cushion 10 wrapped with the outer covers 14 and 15 is located on the lower support plate 21. By driving a motor (not shown), the upper support plate 20 is lowered toward the lower support plate 21 to sandwich the cushion 10 therebetween. After the cushion 10 is compressed to the extent that the marginal edge portions of the adjacent outer covers are overlapped with respect to each other, the sewing device 24 is adjusted through the rotation of the crank handle 97 and knob 101 into a position most fitted to sew together the marginal edge portions of the adjacent outer covers. The outer marginal edge portions of the adjacent outer covers are sewn together by moving the sewing device 24 around the table 43 through the carrier member 63 while driving the motor 67. As a result, a mattress is formed. Where a mattress of different thickness is formed, the outer marginal edge portions of the adjacent outer covers can be sewn together without varying the level of the sewing device 24 merely by vertically moving the lower support plate 21.

Explanation wil now be made of the case where a mattress of different width is formed.

Figure 11:
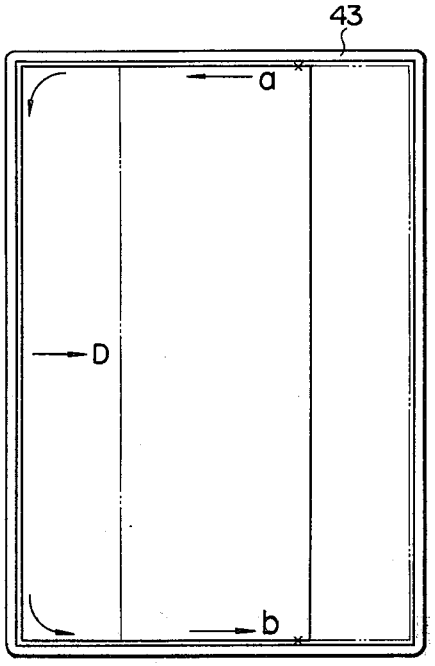
FIG. 11 is an explanatory view showing the operational direction of the sewing machine.

In the case of a mattress of double width, the third member 113 is moved in a direction of B as shown in FIG. 6 so as to fit the lever 115 of the latch mechanism 114 into the engaging hole 118, thereby locating the support plate 21 as shown in FIG. 7. When both the support plates 20 and 21 are located into the second position substantially corresponding to the double width of the mattress, the motor 67 is driven so that the outer marginal edge portions of the covers on the cushion are sewn together, while the sewing device is moved around the table 43, to complete a mattress.

Where a mattress of single width is formed, the third member 113 is moved in a direction opposite to the direction arrow B in FIG. 6. Both the support plates 20 and 21 are located as shown in FIG. 6 in the first position substantially corresponding to the single width of the mattress and in this case the support plates 20 and 21 are located on the left side as indicated by solid lines in FIG. 11. The outer marginal edge portions of the adjacent covers on the cushion are sewn together, starting in the neighborhood of a location *a* at the rear side of the box-like covers and ending in the neighborhood of a location *b* at the front side of the box-like cover, while tracing along a line indicated by arrows in FIG. 11. However, no further sewing can be effected at this position, since the rack 44 is preliminarily formed so as to correspond to the double width of the mattress. In consequence, the sewing device is stopped at this position. The support plates 20 and 21 are moved in the direction of an arrow D in FIG. 11 into a position indicated by a dot-dash line in FIG. 11 by driving the motor 120 for a predetermined time period. As a result, the remaining outer marginal edge portions of the adjacent mattress covers are located along the line of the rack 44 and sewing is again started with respect to the remaining outer marginal edge portions of the adjacent mattress covers. As a result, the entire outer marginal edge portions of the adjacent mattress covers can be sewn together as a whole.

Where the mattress of semi-double width is formed, the support plates 20 and 21 are moved, in the direction of arrow B, from the first position to the third position substantially corresponding to the semi-double width of the mattress and sewing is effected as in the case of the single width mattress sewing.

According to this invention, uniform mattresses can be mass produced, without requiring any skill, by wrapping the cushion with a box-like outer cover, while disposing the outer cover under the open end of the box-like cover, uniformly compressing the wrapped cushion in the direction of the thickness of the wrapped cushion to permit the outer marginal edge portions of the adjacent outer covers to extend outwardly, and sewing together the outer marginal edge portions of the adjacent outer covers.

What is claimed is:

1. A mattress covering sewing machine comprising:

a pair of upper and lower support means each having a flat variable width support assembly and adapted to sandwich therebetween a cushion covered on all sides with outer covers, the widths of the variable width support assemblies being adjustable so as to correspond to the width of a mattress to be formed;

compressing means for substantially uniformly compressing the covered cushion, in the direction of the thickness of the covered cushion, through at least one support assembly;

sewing means for sewing together the outer marginal edge portions of the adjacent outer covers in such a compressed state to form a mattress; and feeding means for supportingly feeding said sewing means around the entire outer marginal edge portions of the outer covers.

2. The mattress covering sewing machine according to claim 1, in which said support assemblies each include a pair of flat plate members having ends which selectively abut each other in the same plane, and an intermediate plate member secured at one end portion to one of the pair of plate members and slidably movable on the other of the pair of plate members, and each of said support means further includes a mechanism for moving a plate member in the direction of the width of the mattress.

3. The mattress covering sewing machine according to claim 2, in which one plate member of said pair of plate members is fixed and the other of said pair of plate members is movable, said intermediate plate member is movable together with said movable plate member and has a plurality of holes therein, said intermediate plate member overlapping the fixed plate member, and said support means further includes a locking mechanism disposed on the side opposite to the side on which said intermediate plate member is disposed and in a position where the intermdiate plate member is overlapped with respect to the adjacent fixed plate member, said locking mechanism having an engaging lever whose end is urged toward the intermediate plate member so as to be engaged into a corresponding hole in the intermediate plate member.

4. The mattress covering sewing machine according to claim 2, in which each of said pair of support means includes a base for movably supporting the respective support assembly in a direction of the width of the mattress and said mechanism includes a rack mounted on the plate member which oppositely faces the base, pinion gears mounted on the base so as to be engaged with pinion gears and a motor mounted on the base so as to drive the pinion gears.

5. The mattress covering sewing machine according to claim 2, in which said feeding means includes a table having a serrated outer perihery and carrying said lower support means, and a carrier member having a pinion gear engaged with the serrated periphery of the table and adapted to be moved along the outer periphery of the table, said carrier means carrying said sewing means.

6. The mattress covering sewing machine according to claim 5, in which said feeding means includes a motor mounted on the carrier member and a clutch mechanism operatively connected by a belt to said motor so as to transmit a drive force to an associated pinion gear.

7. The mattress covering sewing machine according to claim 5, in which said feeding means includes a carrier mechanism swingably mounted on the carrier member so as to be moved in forward and backward directions.

8. The mattress covering sewing machine according to claim 2, in which there is further provided a moving means for vertically moving the lower support means, and said compressing means includes means for lowering said upper support means to substantially uniformly compress the cushion.

9. The mattress covering sewing machine according to claim 8, in which said feedig means includes a table having a serrated outer periphery and carrying said lower support means, a carrier member having a pinion gear engaged with the serrated periphery of the table and adapted to be moved along the outer periphery of the table, said carrier means carrying said sewing means.

10. The mattress covering sewing machine according to claim 8, in which one plate member of said pair of plate members if fixed and the other of said pair of plate members is movable, said intermediate plate member is movable together with said movable plate member and has a plurality of holes therein, said intermediate plate member overlapping the fixed plate member, and said support means further includes a locking mechanism disposed on the side opposite to the side on which said intermediate plate member is disposed and in a position where the intermediate plate member is overlapped with respect to the adjacent fixed plate member, said locking mechanism having an engaging lever whose end is urged toward the intermediate plate member so as to be engaged into a corresponding hole in the intermediate plate member.

11. The mattress covering sewing machine according to claim 8, in which each of said pair of support means includes a base for movably supporting the respective support assembly in a direction of the width of the mattress and said mechanism includes a rack mounted on the plate member which oppositely faces the base, pinion gears mounted on the base so as to be engaged with pinion gears and a motor mounted on the base so as to drive the pinion gears.

12. The mattress covering sewing machine according to claim 8, in which said compressing means includes a connector having a fixed end connected to said upper support means and an internally threaded open end, and further includes a rotatably supported drive shaft having an external thread threadably inserted into the internal thread of said connector, said drive shaft being restricted in its axial movement, the lower support means being vertically movable through said connector by rotation of said drive shaft.

13. A mattress covering sewing machine comprising:

a pair of upper and lower support means each having a flat support assembly and adapted to sandwich therebetween a cushion covered on all sides with outer covers therebetween;

compressing means for lowering said upper support means to substantially uniformly compress the covered cushion, in the direction of the thickness of the covered cushion, through at least one support assembly;

means for vertically moving said lower support means;

sewing means for sewing together the outer marginal edge portions of the adjacent outer covers in such a compressed state to form a mattress; and feeding means for supportingly feeding said sewing means around the entire outer marginal edge portions of the outer covers.

14. The mattress covering sewing machine according to claim 13, in which said compressing means includes a connector having a fixed end connected to said upper support means and an internally threaded open end, and further includes a rotatably supported drive shaft having an external thread threadably inserted into the internal thread of said connector, said drive shaft being restricted in its axial movement, the lower support means being vertically moveable through said connector by rotation of said drive shaft.

* * * * *